US005701637A

United States Patent [19]

Graf

[11] Patent Number: 5,701,637

[45] Date of Patent: Dec. 30, 1997

[54] SAWTOOTH WIRE FOR ALL-STEEL CLOTHING

[75] Inventor: Ralph Armin Graf, Freienbach, Switzerland

[73] Assignee: Graf+Cie AG Kratzen- und Maschinenfabrik, Rapperswil, Switzerland

[21] Appl. No.: 693,606

[22] Filed: Aug. 7, 1996

[30] Foreign Application Priority Data

Aug. 7, 1995 [DE] Germany ..... 195 28 976.5

[51] Int. Cl.[6] ..... D01G 15/88

[52] U.S. Cl. ..... 19/114

[58] Field of Search ..... 19/113, 114

[56] References Cited

U.S. PATENT DOCUMENTS

| | | | |
|---|---|---|---|
| 2,937,412 | 5/1960 | Hollingsworth | 19/114 |
| 3,204,297 | 9/1965 | Wada | 19/114 |
| 4,268,937 | 5/1981 | Grimshaw | 19/114 |
| 4,964,195 | 10/1990 | Hollingsworth | 19/114 |
| 5,185,905 | 2/1993 | Kuppers et al. | 19/114 |

FOREIGN PATENT DOCUMENTS

| | | |
|---|---|---|
| 1686097 | 10/1954 | Germany . |
| 2539089 | 3/1977 | Germany . |
| 631751 | 8/1982 | Switzerland . |

*Primary Examiner*—John J. Calvert
*Attorney, Agent, or Firm*—Herbert Dubno; Andrew Wilford

[57] ABSTRACT

A sawtooth wire for an all-steel fiber-working clothing is formed unitarily with a longitudinally extending foot having a longitudinally extending base surface and a blade extending from the foot and formed with teeth having tips. The blade tapers uniformly outward from the foot toward the tips. The teeth are symmetrical to a plane extending longitudinally and perpendicular to the base surface.

3 Claims, 3 Drawing Sheets

SAWTOOTH WIRE FOR ALL-STEEL CLOTHING

FIELD OF THE INVENTION

The present invention relates to an all-steel clothing of a fiber-working machine. More particularly this invention concerns a sawtooth wire for such a clothing used on a card or stripper.

BACKGROUND OF THE INVENTION

A standard sawtooth wire for all-steel clothings has a foot extending from a wire base lying substantially on a plane or on a part-cylindrical surface and a blade tapering uniformly outward to tooth tips from the foot. Such wires are used for working textile fibers. To this end they are for example wound in a spiral on a cylindrical support of a drum or of a stripper roller of a card. In addition such sawtooth wires are used in open-ended spinning devices as all-steel clothings for stripper rollers.

In the known applications sawtooth-wire all-steel clothings as fiber guides have almost completely replaced the hitherto used clothings comprised of individual needles bedded in a support. This is generally due to the relative ease of manufacture as well as the high durability of the all-steel clothings.

Figure 3B:
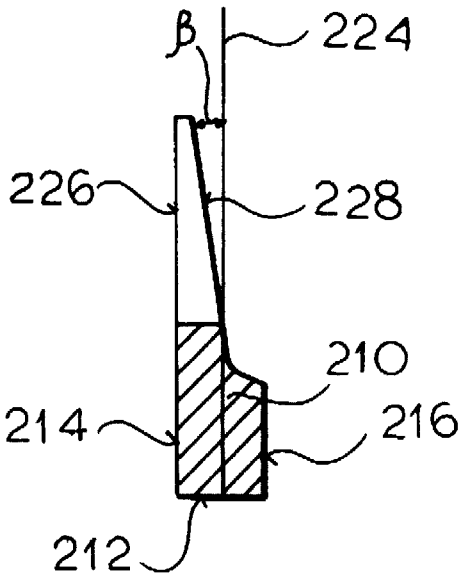
PRIOR ART FIG 3b
FIG. 3*b* is a cross section through the prior-art wire of FIG. 3*a*.
Figure 3A:
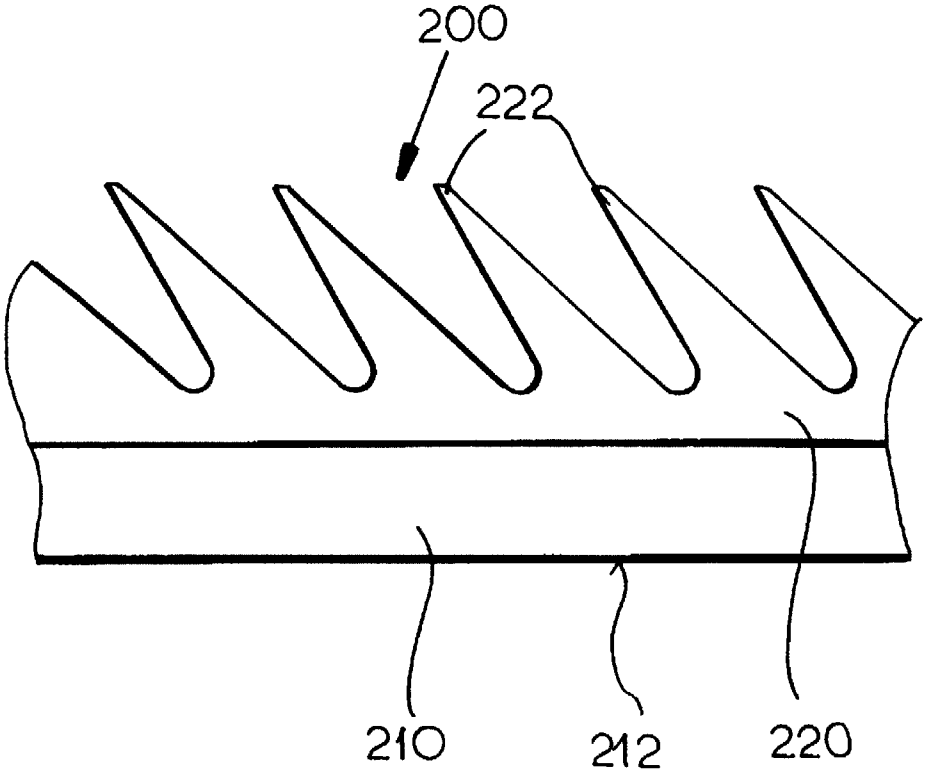
FIG.3a PRIOR ART
FIG. 3*a* is a view like FIG. 1*a* of a prior-art wire.

An example of the production of sawtooth wires for use in all-steel clothings is shown in FIGS. 3*a* and 3*b* in which reference is made to international standard ISO 5234. A standard sawtooth wire 200 consists of a foot 210 extending from a generally planar wire base 212 and a blade 220 thereon provided with teeth 222. In order to draw out the sawtooth wire 200 the foot 210 is made on a support of deformable metal while the blade 220 is formed of relatively unshapable hardened steel. To facilitate the drawing out of such sawtooth wires 200 on a roller-shaped support they can be bent as they are manufactured. Then the wire base 212 has the shape of a part-cylindrical surface.

As can be seen from FIG. 3*b* the foot 210 is delimited by two foot flanks 214 and 216 extending perpendicular to the wire base 212. The blade 220 is delimited by two blade flanks 226 and 228, with the blade flank 226 coplanar with the foot flank 214 while the blade flank 228 forms an acute angle β with a plane 224 extending perpendicular to the wire base 212. In this manner the blade 220 tapers uniformly starting from the foot 210 to the tips of the teeth 222 in order in this manner to increase generally in the region of the tips of the teeth 222 the space available for working the fibers between the individual adjacent sawtooth-wire sections of an all-steel clothing without undesired loss of transverse stability, that is the stiffness to stresses in a direction perpendicular to the blade flank 226 of the blade 220.

Even though sawtooth wires of the type described with reference to FIGS. 3*a* and 3*b* have the above-claimed advantages of relatively simple manufacture one has seen that they could be better with respect to the way they guide fibers. For example with the use of standard sawtooth wires as all-steel clothings for the drum of a card one can see that a relatively large amount of fibers is held over several revolutions by the clothing. The same is seen with stripper rollers provided with standard all-steel clothings.

OBJECTS OF THE INVENTION

It is therefore an object of the present invention to provide an improved sawtooth wire for an all-steel clothing.

Another object is the provision of such an improved sawtooth wire for an all-steel clothing which overcomes the above-given disadvantages, that is which guides the fibers well while being relatively resistant to fouling.

SUMMARY OF THE INVENTION

A sawtooth wire for an all-steel fiber-working clothing according to the invention is formed unitarily with a longitudinally extending foot having a longitudinally extending base surface and a blade extending from the foot and formed with teeth having tips. The blade tapers uniformly outward from the foot toward the tips. The teeth are symmetrical to a plane extending longitudinally and perpendicular to the base surface.

With an all-steel clothing formed of such a sawtooth wire wound on a roller support there is formed between the sawtooth-wire sections of adjacent toothed blade sections a space symmetrical to a plane perpendicular to the roller axis for holding the fibers being worked. The slight deviation from this symmetrical arrangement created by the helical mounting of the sawtooth wire is ignored in the following. The symmetrical arrangement of the working spaces creates minimal shear in the fibers inside this space during rotation of the roller about its axis. As a result the sawtooth wire formed according to the invention creates substantially less shear and therefore less crimping of the fibers inside the working space. Overall there is thus better fiber flow so that fewer fibers are entrained over several revolutions of the roller. This advantage is particularly seen with smaller roller diameters and especially with stripper rollers.

In order to increase the working space available between the blade sections of adjacent wire segments the blade has maximum transverse width that is smaller than a maximum transverse width of the foot.

To simplify the manufacture of sawtooth wires according to the invention it is particularly advantageous when the foot is symmetrical to a plane extending longitudinally and perpendicular to the base surface.

In particular in use of the inventive sawtooth wire with a short foot height it is preferred to increase the transverse stiffness, that is the resistance to stresses in a direction parallel to the roller axis when the foot has a flank extending longitudinally perpendicular to the base surface.

According to the invention the wire has measured perpendicular to the base surface and parallel to the plane an overall height that forms with a height of the foot flank measured perpendicular to the base surface and parallel to the plane a ratio of at least 5.7:1. Sawtooth wires with such a large ratio of overall height of the wire to the foot height are in particular usable as clothings for stripper rollers of a card. In order to improve the fiber transfer from the drum to the stripper roller the blade width at the tooth tips is preferably 0.12±0.02 mm or less. Such a narrow blade with at the tooth tips can with the sawtooth wires according to the invention with a ratio of overall height of the wire to foot height of 5.7:1 or more be achieved because the symmetrical formation of the blade increases its transverse stiffness.

In a particularly preferred embodiment of the invention for making a clothing for a stripper roller of a card with the invention each tooth has a throat depth of about 3 mm and the foot has a height of about 0.7 mm measured perpendicular to the base surface and parallel to the plane.

Along with the above-given advantages the sawtooth wire according to the invention are easy to mount as all-steel clothings as a result of its symmetrical blade.

In the sawtooth wire according to the invention the foot has a flank forming with the base surface an acute angle. Such sawtooth wires are particularly easy to produce for example by using a cold-rolling system when the foot flank forming an acute angle with the wire base runs coplanar with the thereto joined blade flank.

In order to use smooth support rollers with such sawtooth wires the foot has two foot flanks extending parallel to each other. In this way the surfaces at which the foot sections of adjacent sawtooth-wire sections bear against each other can be raised to increase the transverse stability of the clothing.

To produce a clothing for the drum of a card the wire has an overall height forming with a height of the foot a ratio of less than 2:1. The blade has a flank coplanar with the foot flank measured perpendicular to the base surface and parallel to the plane.

Such a wire can be used as an all-steel clothing for a stripper roller of a card or for a drum of a card.

SPECIFIC DESCRIPTION

Figure 1B:
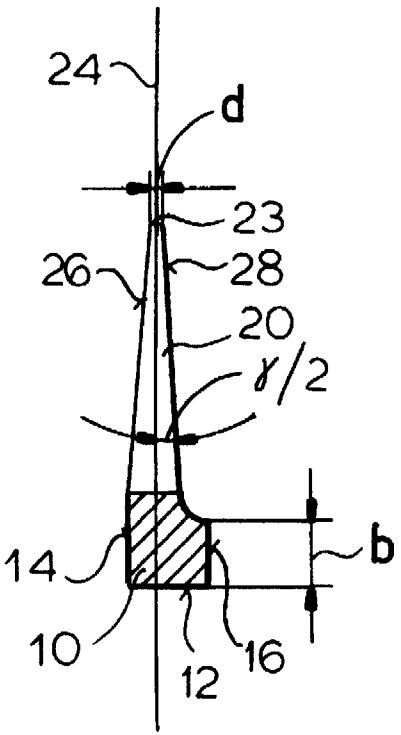
FIG. 1*b* is a cross section through the wire of FIG. 1*a;*
Figure 1A:
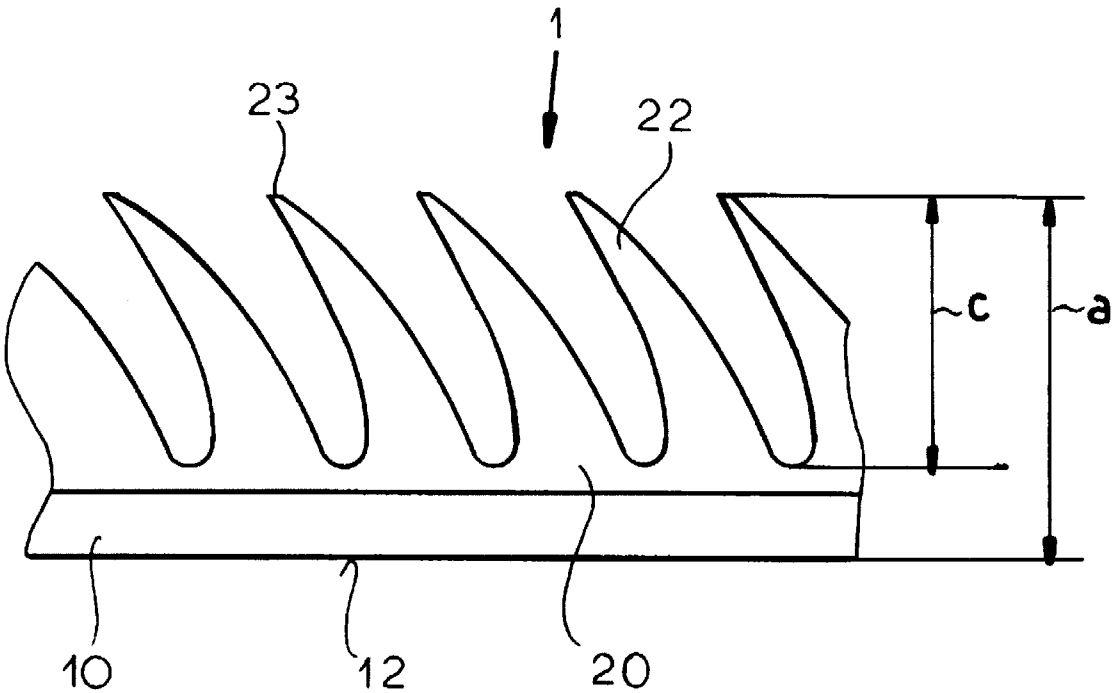
FIG. 1*a* is a side view of the wire according to this invention.
Figure 1C:
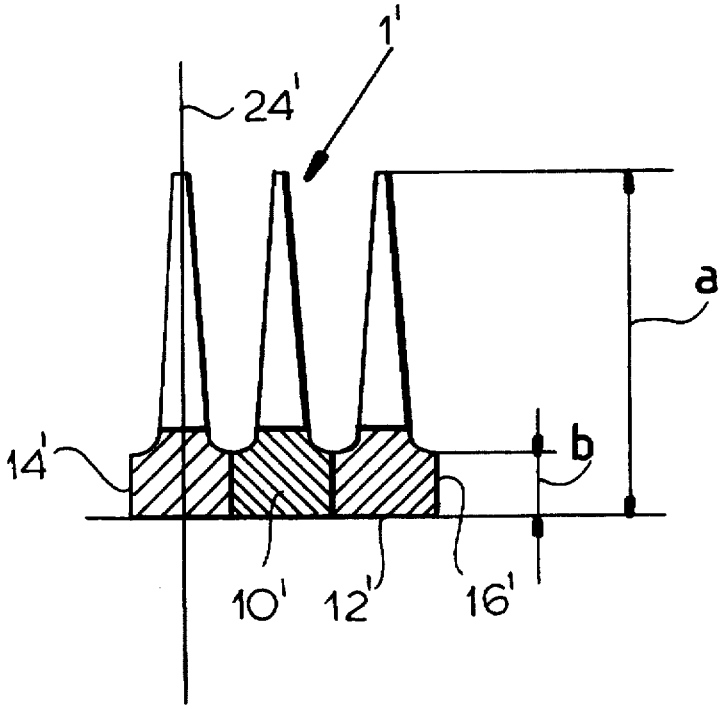
FIG. 1*c* is a view like FIG. 1*b* but showing another wire according to the invention.

FIGS. 1*a* through *c* show a sawtooth wire 1 for the production of an all-steel clothing for a stripper roller of a carding machine. As can be seen in FIG. 1*a* the sawtooth wire 1 consists of a foot 10 extending from a wire base 12 and a blade 20 connected thereto. The blade 20 is provided with sawteeth 22 shaped arcuately, that is with a curved edge. The curved edge of the teeth 22 ensures a uniform distribution of the fibers being worked over the entire depth c of the teeth. This increases the resistance to wear of the sawtooth wire 1. In addition the embodiment of the sawtooth wire 1 with curved sawteeth 22 produces less collection of neps or husks at the tooth bases and improves the transfer of fibers between the drum and the stripper.

As shown in FIG. 1*b* the blade 2 tapers outward from the foot 10 continuously to the tooth tips 23. In addition the blade 20 is mirror-symmetrical relative to a plane 24 perpendicular to the wire base 12. As a result of this formation where the blade flanks 26 and 28 each form an angle of $\gamma/2$ with the plane 24 the all-steel clothing nearly is a symmetrical needle clothing. This produces good fiber guiding and thus good flow of the fibers.

As can be further seen from FIG. 1*b*, the foot 10 has two foot flanks 14 and 16 extending perpendicular to the wire base 12. This ensures that even with a height b of the foot flank 16 perpendicular to the wire base 12 of only 0.7 mm there is a sufficiently great transverse stability of an all-steel clothing of a sawtooth wire 1 wound around a roller body wherein the foot flank 14 extending perpendicular to the wire base 12 lies directly against the foot flank 16 extending perpendicular to the wire base 12 of an adjacent wire section. This transverse stability can be produced by the use of a sawtooth wire 1 itself when the relationship of the overall height a of the sawtooth wire 1 to the height b of the foot flank 16 perpendicular to the wire base has a value of at least 5.7:1. Such a large ratio of the overall height a of the wire to the foot height b allows without unnecessarily great use of material the formation of teeth 22 with a tooth throat depth c of 3 mm or more.

The symmetrical formation of the blade 20 can be achieved itself with such a large blade throat depth c with a sufficiently great lateral stiffness of the teeth 22. In the illustrated embodiment wherein the angle $\gamma$ between the tooth flanks 26 and 28 is about 9° even then one obtains a sufficiently great transverse stiffness of the teeth 22 when the blade width d at the tooth tips is only 0.12±0.02 mm or even less.

As can be deduced from the preceding description it is possible to produce with the sawtooth wires of the type shown in FIGS. 1*a* and 1*b* an all-steel clothing having a sufficiently great transverse stability and stiffness of the teeth 22 for the stripper roller of a card while simultaneously minimizing the amount of material needed and ensuring a satisfactory flow of material during working of the fibers.

Sawtooth wires of the type shown in FIGS. 1*a* and 1*b* are for example produced by a cold-rolling process wherein the upper and lower rollers are both profiled. It is possible to simplify the production of the sawtooth wires with a symmetrically shaped blade 20 when the foot 10 is also made symmetrically with respect to a plane 24 extending perpendicular to the wire base 12. A sectional view of such a sawtooth wire 1' is shown in FIG. 1*c*. The sawtooth wire 1' shown in this figure corresponds in generally to the sawtooth wire described with reference to FIGS. 1*a* and 1*b* with functionally identical structure primed. It is merely provided with a foot 10' that is also symmetrical to a plane 24' perpendicular to the wire base 12'. Thus the sawtooth wire 1' shown in FIG. 1*c* can be produced by symmetrically formed lower and upper rollers in a cold-rolling system.

Figure 2:
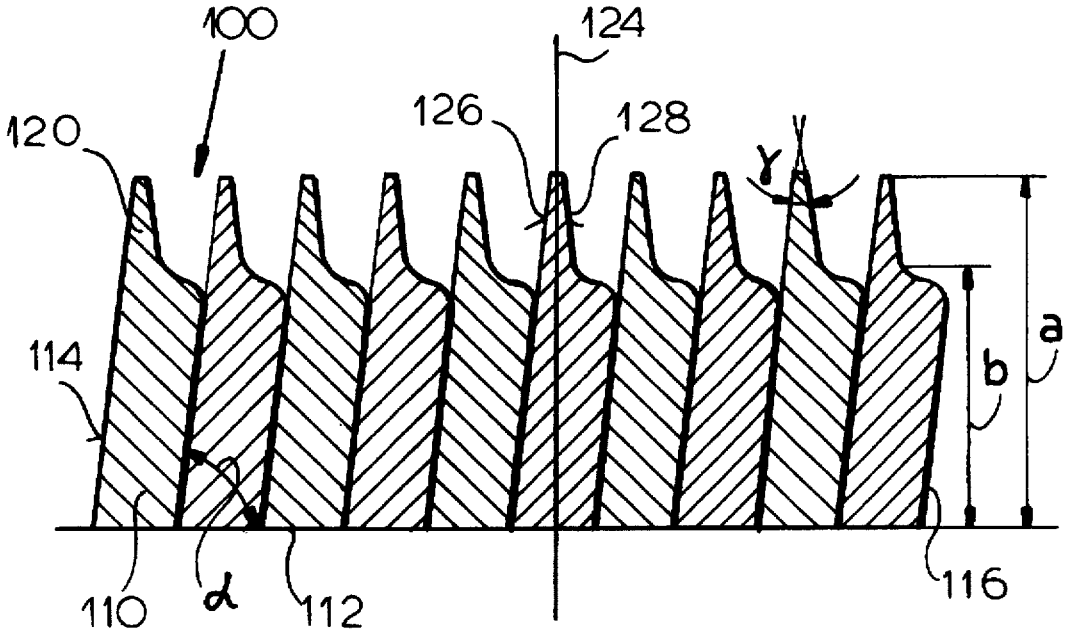
FIG. 2 is a view like FIG. 1*c* showing another wire in accordance with this invention.

FIG. 2 shows a portion of an axial section through a clothing made from a sawtooth wire 100 according to this invention and fitted to a drum of a carding machine. The sawtooth wire 100 that is wound helically around the roller to form the clothing is formed of a foot 110 extending from the generally planar wire base 112 with a height b and a blade 120 with the ratio of the overall height a to the foot height b substantially greater than 2:1.

The foot flanks 114 and 116 extend parallel to each other and form an acute angle $\alpha$ with the wire base 112. The blade 120 formed symmetrical to a plane 124 extending perpendicular to the wire base 112 has a blade flank 126 extending coplanar with the foot flank 114, that is at an angle $\alpha$ equal to 90° minus $\gamma/2$, where $\gamma$ is the angle between the blade flanks 126 and 128. Sawtooth wires 100 formed in this manner can be produced by means of a smooth lower roller in a cold-rolling process.

The invention is not limited to the embodiments shown in the drawing. Instead it covers sawtooth wires according to the invention with a captured or interlinked foot. In addition sawtooth wires according to the invention can also be used to produce clothings of separating rollers. To this end the above-given advantages also produce an improved fiber guiding and an improved fiber flow.

I claim:

1. A sawtooth wire for an all-steel fiber-working clothing formed unitarily with:

a longitudinally extending foot having a longitudinally extending base surface and a pair of parallel flanks one of which forms with the base surface an acute angle, the base surface bridging the flanks; and a blade extending from the foot and formed with teeth having tips and each formed with a flank coplanar with one of the flanks of the foot, the blade tapering uniformly outward from the foot toward the tips, the teeth being symmetrical to a plane extending longitudinally and perpendicular to the base surface.

2. The sawtooth wire defined in claim 1 wherein the blade has a maximum transverse width that is smaller than a maximum transverse width of the foot.

3. The sawtooth wire defined in claim 1 wherein measured perpendicular to the base surface and parallel to the plane the wire has an overall height forming with a height of the foot a ratio of less than 2:1.

* * * * *